US008542170B2

(12) United States Patent
Guo et al.

(10) Patent No.: US 8,542,170 B2
(45) Date of Patent: Sep. 24, 2013

(54) DISPLAY DEVICE HAVING DATA DRIVER ADJUSTING SETUP TIME AND HOLD TIME

(75) Inventors: Wei Guo, Shenzhen (CN); Sha Feng, Shenzhen (CN)

(73) Assignees: Innocom Technology (Shenzhen) Co., Ltd. (CN); Chimei Innolux Corporation (TW)

( * ) Notice: Subject to any disclaimer, the term of this patent is extended or adjusted under 35 U.S.C. 154(b) by 405 days.

(21) Appl. No.: 12/770,756

(22) Filed: Apr. 30, 2010

(65) Prior Publication Data

US 2011/0096067 A1 Apr. 28, 2011

(30) Foreign Application Priority Data

Oct. 26, 2009 (CN) ..... 2009 1 0308814

(51) Int. Cl.
*G09G 3/36* (2006.01)

(52) U.S. Cl.
USPC ..... 345/87; 345/99

(58) Field of Classification Search
USPC ..... 345/3.2, 87, 213, 99
See application file for complete search history.

(56) References Cited

U.S. PATENT DOCUMENTS

| | | | | |
|---|---|---|---|---|
| 6,980,266 | B2 | 12/2005 | Choi | |
| 2005/0057487 | A1* | 3/2005 | Takata et al. | 345/102 |
| 2007/0182690 | A1* | 8/2007 | Lin | 345/100 |
| 2008/0049006 | A1* | 2/2008 | Yi et al. | 345/211 |
| 2008/0077903 | A1* | 3/2008 | Dinter et al. | 716/11 |
| 2008/0158234 | A1* | 7/2008 | Kim | 345/501 |

FOREIGN PATENT DOCUMENTS

| | | | |
|---|---|---|---|
| TW | I282961 | B | 11/2005 |
| TW | 200826041 | A | 6/2008 |

* cited by examiner

*Primary Examiner* — Chanh Nguyen
*Assistant Examiner* — Tsegaye Seyoum
(74) *Attorney, Agent, or Firm* — Bacon & Thomas, PLLC

(57) ABSTRACT

A display device includes a display panel having an adjustable refresh frequency, a data driver for receiving display data, generating driving voltages based on the display data, and driving the display panel to display images using the driving voltages, and a timing controller providing a timing control signal to the data driver. The timing control signal is generated according to the refresh frequency of the display panel. The data driver dynamically adjusts a setup time and a hold time of the data driver according to the timing control signal.

14 Claims, 4 Drawing Sheets

DISPLAY DEVICE HAVING DATA DRIVER ADJUSTING SETUP TIME AND HOLD TIME

BACKGROUND

1. Technical Field

The present disclosure relates to display technology, and more particularly, to a display device having a data driver capable of dynamically adjusting a setup time and a hold time of the data driver.

2. Description of Related Art

Liquid crystal displays (LCD) provide advantages of portability, low power consumption, and low radiation, and thus have been widely used in various portable information products.

A typical LCD includes a liquid crystal panel having a plurality of pixel units, a gate driver (namely, a gate IC) providing scanning signals to the pixel units, and a data driver (namely, a source IC) providing gray scale voltages to the scanned pixel units. The data driver receives display data from a timing controller, converts the display data to corresponding gray scale voltages, and outputs the gray scale voltages to the scanned pixel units, driving the pixel units to display corresponding images.

Generally, the display data is provided to the data driver in a reduced swing differential signaling (RSDS) form. To enable the data driver to successfully receive and identify the RSDS data, a setup time and a hold time are preset in the data driver.

Specifically, the setup time is defined as a time period from when an RSDS data arrives at the data driver to a significant RSDS clock signal beginning, that is a prepare time period for fetching the RSDS data. The hold time is defined as a time period from the beginning of the RSDS clock signal to the arriving of a next RSDS data, that is a time period for the data driver to fetch the RSDS data.

Normally, the setup time and the hold time are both preset as fixed values. Nevertheless, a display timing of the LCD may be changed during operation, for example, a refresh frequency of the liquid crystal panel may be adjusted by a user to satisfy a current displaying requirement. In this circumstance, the data driver may be unable to identify the received RSDS display data. This may disable the LCD to function.

What is needed, therefore, is an LCD that can overcome the above-described limitation.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe specific exemplary embodiments of the present disclosure in detail.

Figure 1:
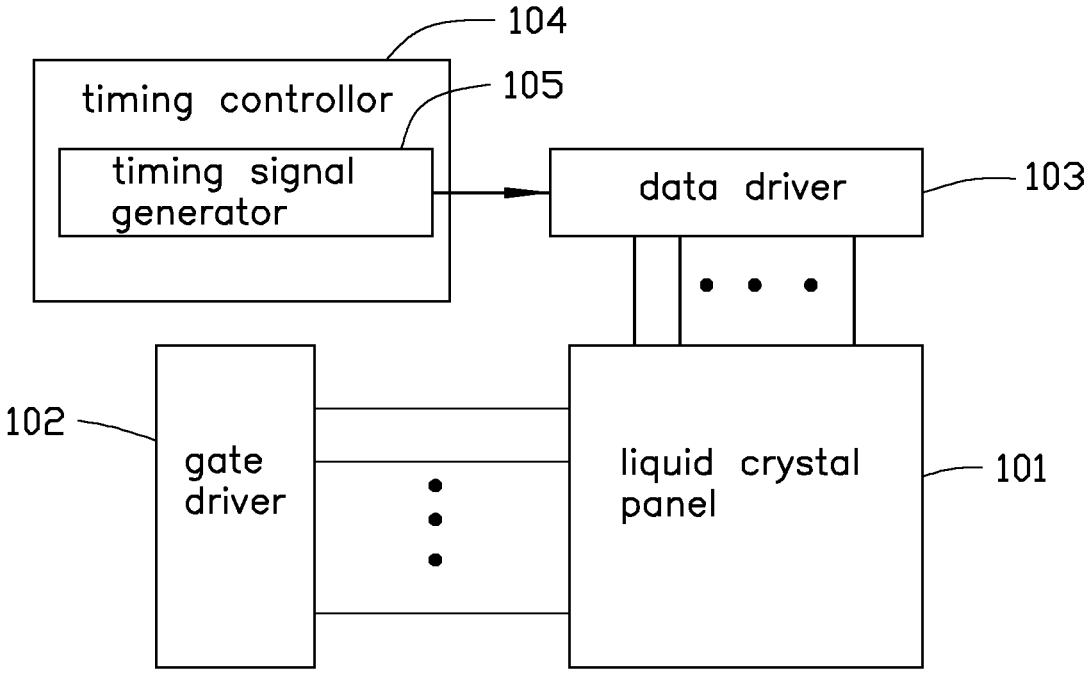
FIG. 1 is a block diagram of a display device according to a first embodiment of the present disclosure, the display device including a timing controller having a timing signal generator.

Referring to FIG. 1, a display device 100 according to a first embodiment of the present disclosure is shown. The display device 100 may be an LCD in one embodiment. The display device 100 includes a liquid crystal panel 101, a gate driver 102, a data driver 103, and a timing controller 104.

The liquid crystal panel 101 include a plurality of pixel units arranged as a matrix. Each pixel unit may include an active element which is configured to activate the pixel unit in response to a scanning signal provided by the gate driver 102. The active element may be a thin film transistor (TFT), which includes a gate electrode electrically coupled to the gate driver 102, a source electrode electrically coupled to the data driver 103, and a drain electrode electrically coupled the a pixel electrode of the pixel unit. Under the control of the timing controller 104, the gate driver 102 may output scanning signals to the pixel units in a determined time interval, so as to activate the pixel units row by row. When the pixel unit is activated, a corresponding data signal (e.g., a gray scale voltage signal) outputted from the data driver 103 is transmitted to the pixel electrode via the active element, such that the pixel unit is driven to display a related image.

The data driver 103 is configured to receive display data from the timing controller 104, convert the display data into corresponding gray scale voltage signals, and output the gray scale voltage signals to the pixel units of the liquid crystal panel 101. In one embodiment, the display data may be in an RSDS form. Moreover, the data driver 103 can also receive a timing control signal from the timing controller 104. The timing control signal may be a 2-bit binary code, which may control the data driver 103 to dynamically configure a setup time and a hold time of the data driver 103 so as to enable the data driver 103 to successfully receive and identify the RSDS display data. For example, the data driver 103 may include a look-up table pre-stored in the data driver 103. The table includes a plurality of entries each corresponding to a respective 2-bit binary code. The entries are configured to indicate mapping relations between the 2-bit binary codes and the corresponding setup time values and hold time values.

In one exemplary embodiment, the pre-stored table may be illustrated as follow, where T represents an RSDS clock cycle of the RSDS display date.

| timing control signal | | setup time | hold time |
|---|---|---|---|
| 0 | 0 | T/16-T/2 | T/16 |
| 0 | 1 | 2T/16-T/2 | 2T/16 |
| 1 | 0 | 3T/16-T/2 | 3T/16 |
| 1 | 1 | 4T/16-T/2 | 4T/16 |

Upon receiving the timing control signal, the data driver 103 may select a corresponding entry in the table based on the timing control signal, obtain a setup time value and a hold time value from the selected entry, and then configure the setup time and the hold time the data driver 103 correspondingly.

By use of the table, the data driver 103 can automatically and dynamically adjust the setup time and the hold time the data driver 103, and thereby satisfying different display timing requirements. As such, even if a refresh frequency of the liquid crystal panel 101 is adjusted during an operation of the display device 100, the data driver 103 can identify the received RSDS display data efficiently, and thus generate corresponding gray scale voltage signals all the same.

Reference will now be made to the FIGS. 2-4 to describe the how the timing control signal is provided to the data driver 103.

The timing controller 104 is configured to receive original display data from an interface circuit (not shown), convert the original display data into the RSDS form, and then provide the RSDS display data to the data driver 103. In particular, the original display data may be in a low voltage differential signaling (LVDS) form. Moreover, the timing controller 104 can also generate the 2-bit timing control signal according to the display timing of the display device 100, and output the timing control signal to the data driver 103. In particular, the timing controller 104 may employ a timing signal generator 105 to generate the timing control signal.

Figure 2:
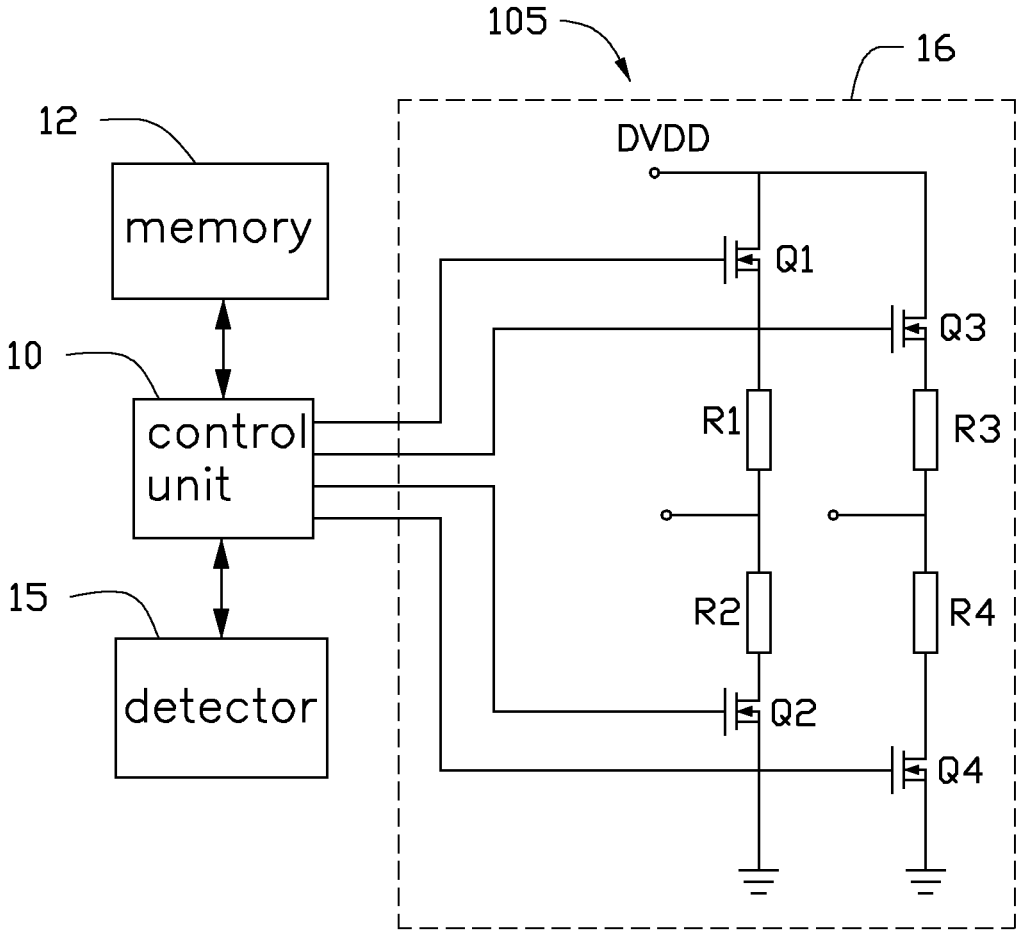
FIG. 2 is a block diagram of the timing signal generator of the timing controller of the display device of FIG. 1.

Referring to FIG. 2, in one embodiment, the timing signal generator 105 includes a memory 12, a control unit 10, a detector 15, and a digital code converter 16. The memory 12 may be an electrically erasable programmable read-only memory (EEPROM), which is used to store a plurality of timing codes each corresponding to a refresh frequency. Each timing code is a 4-bit digital code, and can be selected and outputted by the control unit 10 to the digital code converter 16 as to generate a corresponding timing control signal. For example, a 4-bit digital code (1, 1, 0, 0) may correspond to a refresh frequency of 60 Hz, while a 4-bit digital code (1, 0, 0, 1) may correspond to a refresh frequency of 75 Hz. In particular, the timing codes can be obtained through experiments on the display device 100 during the manufacturing processor, and pre-stored in the memory 12.

The detector 15 may detect a frequency of the original display data received by the timing controller 104, and provide a frequency indication signal to the control unit 10 in accordance with the detected frequency. By analyzing the frequency of original display data, the detector 15 can obtain a current refresh frequency of the liquid crystal panel 101. When the refresh frequency is adjusted by a user, the detector 15 can update the frequency indication signal, so as to inform the control unit 10 with the adjusted refresh frequency.

The control unit 10 may analyze the frequency indication signal outputted by the detector 15, and thereby obtaining the current refresh frequency of the liquid crystal panel 101. Based on the refresh frequency, the control unit 10 may further select a corresponding one of the timing codes from the memory 12, and then parallel output the timing code to the digital code converter 16.

Upon receiving the timing code, the digital code converter 16 may convert the timing code into a 2-bit timing control signal, and output the timing control signal to the data driver 103, so as to enable the data driver 103 to adjust a setup time and a hold time thereof.

The digital code converter 16 may include a first transistor Q1, a second transistor Q2, a third transistor Q3, and a fourth transistor Q4. The first to fourth transistors Q1-Q4 may be metal oxide semiconductor filed effect transistors (MOSFETs). Gate electrodes of the transistor Q1-Q4 serve as four input terminals of the digital code converter 16, and are configured to receive the 4-bit timing code in parallel. Drain electrodes of the transistors Q1 and Q3 are both electrically coupled to a digital power voltage DVDD, and source electrodes of the transistors Q2 and Q4 are both grounded. Two resistors R1 and R2 are electrically coupled in series between a source electrode of the first transistor Q1 and a drain electrode of the second transistor Q2, and a node between these two resistors R1 and R2 serves as a first output terminal of the digital code converter 16. Two resistors R3 and R4 are electrically coupled in series between a source electrode of the third transistor Q3 and a drain electrode of the fourth transistor Q4, and a node between these two resistors R3 and R4 serves as a second output terminal of the digital code converter 16. The first and second output terminals may cooperative parallel output the 2-bit timing control signal to the data driver 103.

For example, when the detector 15 detects a current refresh frequency of the liquid crystal panel 101 is 60 Hz, the control unit 10 select a corresponding 4-bit timing code (1, 1, 0, 0) from the memory 12, and output the timing code (1, 1, 0, 0) to the digital code converter 16. The timing code (1, 1, 0, 0) causes the first and third transistors Q1 and Q3 to be turned on, while the second and fourth transistor Q2 and Q4 to be turned off. Thus, a 2-bit timing control signal (1, 1) is generated and outputted to the data driver 103 by the digital code converter 16. Based on the timing control signal (1, 1), the data driver 103 obtains a desired setup time value in a range from 4T/16 to T/2 and a hold time value of 4T/16 from the table pre-stored therein, and then configures the setup time and the hold time thereof according to the obtained values. As such, the data driver 103 is ensured to identify the received RSDS display data efficiently and provide corresponding gray scale voltage signals to the liquid crystal panel 101.

Figure 3:
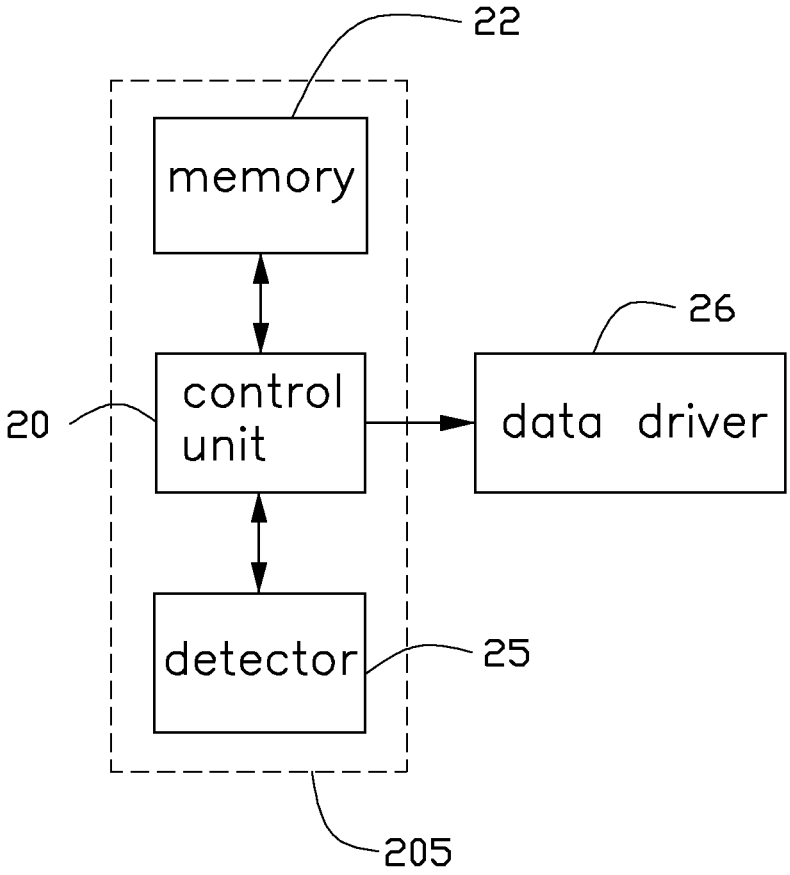
FIG. 3 illustrates a timing signal generator and a data driver of a display device according to a second embodiment of the present disclosure.
Figure 4:
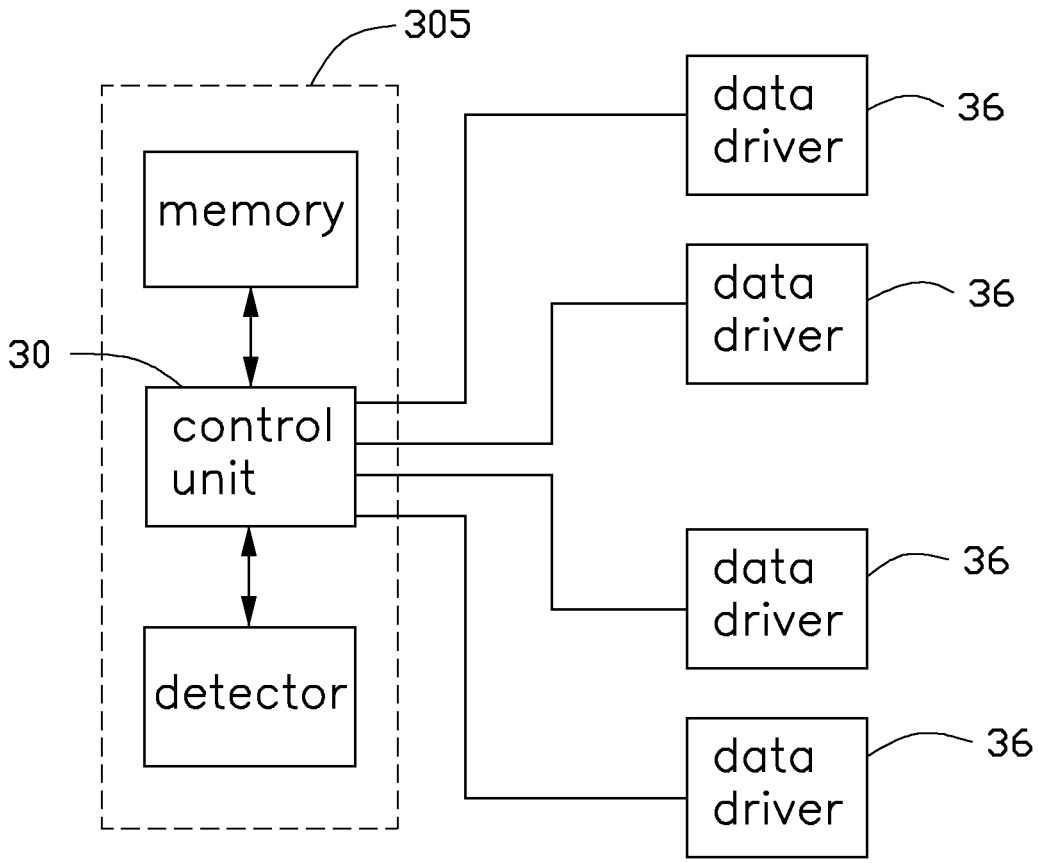
FIG. 4 illustrates a timing signal generator and multiple data drivers of a display device according to a third embodiment of the present disclosure.

In an alternative embodiment, the timing controller 104 can employ another timing signal generator 205 as illustrated in FIG. 3 to generate the timing control signal. Referring to FIG. 3, the timing signal generator 205 is similar to be above-described timing signal generator 105 in FIG. 2, but differs in that the timing signal generator 205 need no digital code convert as illustrated in FIG. 2, instead, the timing control signals corresponding to different refresh frequencies are directly stored in a memory 22 thereof. Specifically, the timing signal generator 205 includes the memory 22, a control unit 20, and a detector 25. In operation, the control unit 20 may select a corresponding 2-bit timing control signal from the memory 22 based on the current refresh frequency detected by the detector 25, and directly output the timing control signal to the data driver 103.

Furthermore, when the liquid crystal panel has a relative large size, pixel units of the liquid crystal panel can be divided into a plurality pixel regions. Each pixel region can be driven by a respective data driver. That is, multiple data drivers may be adopted in the display device to drive different regions of pixel units. Referring to FIG. 4, in such kind of display device, the control unit 30 of the timing signal generator 305 may simultaneously output the timing control signals to multiple data drivers 36, such that multiple data drivers 36 can configure the setup time and the hold time properly.

It is to be further understood that even though numerous characteristics and advantages of a preferred embodiment have been set out in the foregoing description, together with details of the structures and functions of the embodiments, the disclosure is illustrative only; and that changes may be made in detail, especially in matters of shape, size and arrangement of parts within the principles of present disclosure to the full extent indicated by the broad general meaning of the terms in which the appended claims are expressed.

What is claimed is:

1. A display device, comprising:

a display panel having an adjustable refresh frequency;

a timing controller configured to provide a timing control signal, the timing control signal generated according to the refresh frequency of the display panel, the timing controller comprising a timing signal generator configured to detect a refresh frequency of the liquid crystal panel and generate the timing control signal according to the refresh frequency, in which the timing signal generator comprises a control unit and a digital code converter, the control unit configured to select a timing code from a plurality of pre-stored timing codes in accordance with the refresh frequency and output the selected timing code to the digital code converter, wherein the digital converter is configured to convert the timing code to the timing control signal; and a data driver configured to dynamically adjust a setup time and a hold time of the data driver according to the timing control signal, receive and identify display data of the display device based on the adjusted setup time and the adjusted hold time, and provide driving voltages based on the display data directing the display panel to display images, wherein the timing code is a four-bit digital code and the timing control signal is a two-bit digital code, the digital code converter comprises a first transistor, a second transistor, a third transistor, and a four transistor, gate electrodes of the first to fourth transistors are configured to receive the timing code, drain electrodes of the first and third transistors are both electrically coupled to a digital power voltage, source electrodes of the second and fourth transistors are both grounded, a first resistor and a second resistor are electrically coupled in series between a source electrode of the first transistor and a drain electrode of the second transistor, a third resistor and a fourth resistor are electrically coupled in series between a source electrode of the third transistor and a drain electrode of the fourth transistor, and the timing control signal is output from a node between the first and second resistors and a node between the third and fourth resistors.

2. The display device of claim 1, wherein the timing signal generator comprises a detector configured to detect a frequency of the display data, and provide a frequency indication signal comprising the detected result to the control unit.

3. The display device of claim 2, wherein the timing signal generator further comprises a memory configured to provide the pre-stored timing codes, each corresponding to a respective refresh frequency of the display panel.

4. The display device of claim 1, wherein the timing signal generator comprises a control unit and a memory, the memory configured to store timing control signals each corresponding to a respective refresh frequency, the control unit configured to select a corresponding timing control signal from the memory in accordance with the refresh frequency, and output the timing control signal directly to the data driver.

5. The display device of claim 4, wherein the display data received by the data driver is in a reduced swing differential signaling (RSDS) form.

6. The display device of claim 1, wherein the data driver comprises a pre-stored table configured to indicate mapping relations between values of the timing control signal and corresponding setup time values and hold time values.

7. The display device of claim 6, wherein the timing control signal is a digital code, and the pre-stored table comprises a plurality of entries, each corresponding to a respective digital code, and is configured to provide the corresponding setup time value and hold time value, so as to enable the data driver to adjust the setup time and hold time thereof based on the setup time value and the hold time value.

8. A display device, comprising:

a liquid crystal panel having an adjustable refresh frequency;

a timing controller comprising a timing signal generator configured to detect a refresh frequency of the liquid crystal panel, generate a timing control signal according to the refresh frequency, and provide the timing control signal to a data driver, wherein the timing signal generator comprises a control unit and a digital code converter, the control unit is configured to select a timing code from a plurality of pre-stored timing codes in accordance with the refresh frequency and output the selected timing code to the digital code converter, and the digital converter is configured to convert the timing code into the timing control signal; and a data driver configured for receiving display data of the display device, generating driving voltages based on the display data, and driving the liquid crystal panel to display images using the driving voltages;

wherein the data driver automatically adjusts a setup time value and a hold time value according to a refresh frequency of the liquid crystal panel;

wherein the timing code is a four-bit digital code and the timing control signal is a two-bit digital code, the digital code converter comprises a first transistor, a second transistor, a third transistor, and a four transistor, gate electrodes of the first to fourth transistors are configured to parallel receive the timing code, drain electrodes of the first and third transistors are both electrically coupled to a digital power voltage, source electrodes of the second and fourth transistors are both grounded, a first resistor and a second resistor are electrically coupled in series between a source electrode of the first transistor and a drain electrode of the second transistor, a third resistor and a fourth resistor are electrically coupled in series between a source electrode of the third transistor and a drain electrode of the fourth transistor, and the timing control signal is output from a node between the first and second resistors and a node between the third and fourth resistors.

9. The display device of claim 8, wherein the timing signal generator comprises a detector, the detector is configured to detect a frequency of the display data, and provide a frequency indication signal indicating a refresh frequency based on the detected result to the control unit.

10. The display device of claim 9, wherein the timing signal generator further comprises a memory, the memory is configured to provide the pre-stored timing codes each corresponding to a respective refresh frequency of the display panel.

11. The display device of claim 8, wherein the timing signal generator comprises a control unit and a memory, the memory configured to store timing control signals each corresponding to a respective refresh frequency, and the control unit configured to select a corresponding timing control signal from the memory in accordance with the refresh frequency, and output the timing control signal directly to the data driver.

12. The display device of claim 11, wherein the display data received by the data driver is in a reduced swing differential signaling (RSDS) form.

13. The display device of claim 8, wherein the data driver comprises a pre-stored table configured to indicate mapping relations between values of the timing control signal and corresponding setup time values and hold time values.

14. The display device of claim 13, wherein the timing control signal is a digital code and the pre-stored table comprises a plurality of entries, each corresponding to a respective digital code, and configured to provide the corresponding setup time value and hold time value.

* * * * *